US011150011B2

(12) United States Patent
Li et al.

(10) Patent No.: US 11,150,011 B2
(45) Date of Patent: Oct. 19, 2021

(54) REFRIGERATOR CONTROL METHOD FOR CAPTURING IMAGES INSIDE REFRIGERATOR

(71) Applicant: QINGDAO HAIER CO., LTD., Qingdao (CN)

(72) Inventors: Guixi Li, Qingdao (CN); Bing Wang, Qingdao (CN); Qinghai Zhao, Qingdao (CN); Lei Zhang, Qingdao (CN); Shujun Song, Qingdao (CN); Yuliang Jiao, Qingdao (CN); Qingfu Wang, Qingdao (CN); Chunxue Wang, Qingdao (CN)

(73) Assignee: QINGDAO HAIER CO., LTD., Qingdao (CN)

( * ) Notice: Subject to any disclaimer, the term of this patent is extended or adjusted under 35 U.S.C. 154(b) by 81 days.

(21) Appl. No.: 16/609,207

(22) PCT Filed: Oct. 29, 2018

(86) PCT No.: PCT/CN2018/112298
§ 371 (c)(1),
(2) Date: Oct. 28, 2019

(87) PCT Pub. No.: WO2019/085843
PCT Pub. Date: May 9, 2019

(65) Prior Publication Data

US 2020/0064058 A1 Feb. 27, 2020

(30) Foreign Application Priority Data

Nov. 1, 2017 (CN) ..... 201711059895.6

(51) Int. Cl.
*F25D 29/00* (2006.01)

(52) U.S. Cl.
CPC ..... *F25D 29/00* (2013.01); *F25D 2500/06* (2013.01); *F25D 2700/02* (2013.01); *F25D 2700/04* (2013.01); *F25D 2700/06* (2013.01)

(58) Field of Classification Search
CPC .. F25D 29/00; F25D 2500/06; F25D 2700/02; F25D 2700/04; F25D 2700/06
See application file for complete search history.

(56) References Cited

U.S. PATENT DOCUMENTS

2016/0138859 A1* 5/2016 Stimpfig ..... F25D 29/003 62/125
2017/0234602 A1* 8/2017 Seo ..... F25D 23/12 348/151

FOREIGN PATENT DOCUMENTS

CN 104864676 A 8/2015
CN 105698482 A 6/2016
(Continued)

OTHER PUBLICATIONS

CN 105698482 (English translation) (Year: 2016).*

*Primary Examiner* — Jonathan Bradford
(74) *Attorney, Agent, or Firm* — Cheng-Ju Chiang

(57) ABSTRACT

A refrigerator control method, including: upon acquiring a signal indicating that a person approaches to open a door, controlling a camera to move from an initial position to a first position; upon acquiring a signal indicating that the door switches to an open status, controlling the camera to move to a second position; upon acquiring an opening angle of the door, and controlling the camera to capture an image of an interior of the door when the opening angle is less than a threshold angle; upon acquiring a signal indicating that the door switches to the closed status, controlling the camera to move to the first position and capture an image of an interior of the door; and upon acquiring a signal indicating that the door is closed, controlling the camera to return to the initial
(Continued)

position and capture an image of an interior of the refrigerating compartment.

8 Claims, 3 Drawing Sheets

(56) References Cited

FOREIGN PATENT DOCUMENTS

| | | | |
|---|---|---|---|
| CN | 107270627 | A | 10/2017 |
| CN | 107278257 | A | 10/2017 |
| CN | 108106321 | A | 6/2018 |
| KR | 10-2014-0125105 | A | 10/2014 |

* cited by examiner

REFRIGERATOR CONTROL METHOD FOR CAPTURING IMAGES INSIDE REFRIGERATOR

REFRIGERATOR CONTROL METHOD

The present application is a 35 U.S.C. § 371 National Phase conversion of International (PCT) Patent Application No. PCT/CN2018/112298, filed on Oct. 29, 2018, which claims the priority to the Chinese Patent Application having an application date of Nov. 1, 2017, an application number of 201711059895.6, and a title of "Refrigerator Control Method", which is incorporated herein by reference in its entirety. The PCT International Patent Application was filed and published in Chinese.

TECHNICAL FIELD

The present invention relates to the field of home appliance and in particular to a refrigerator control method.

BACKGROUND

At present, a very small number of refrigerators are provided with imaging apparatuses in a storage chamber to take photos or videos of the food or other articles stored in the storage chamber for monitoring the freshness of the food, the situation of the storage chamber or the like, which thereby improves the intelligence of the refrigerator. In the prior art, the refrigerator is generally provided with two or more cameras to collect images of the food inside the box and the door of the refrigerator for image recognition. However, the cost of providing a plurality of cameras is relatively high. In addition, since an opening angle of the door is large when images are shot, the imaging may be delayed, and photos of the user may be taken, which results in a high photo rejection rate.

SUMMARY

An object of the present invention is to provide a refrigerator control method that solves the above technical problem. In the method, images of interiors of a refrigerating compartment and a door of the refrigerator can be captured by only one camera in the refrigerating compartment.

To realize the above object, the present invention provides a refrigerator control method. The refrigerator comprises a refrigerating compartment, a door closing the refrigerating compartment, and a camera movably disposed in the refrigerating compartment for capturing images of interiors of the refrigerating compartment and the door; and the method comprises:

upon acquiring a signal indicating that a person approaches and wants to open the door of the refrigerator, controlling the camera to move from an initial position to a first position;

upon acquiring a signal indicating that the door switches to an open status from a closed status, controlling the camera to gradually move from the first position to a second position;

upon acquiring an opening angle of the door, comparing the opening angle of the door with a threshold angle, and controlling the camera to capture an image of an interior of the door when the opening angle of the door is less than the threshold angle;

upon acquiring a signal indicating that the door switches to the closed status from the open status or upon acquiring a signal indicating that the opening angle of the door is gradually decreased, controlling the camera to gradually move to the first position and capture an image of an interior of the door; and upon acquiring a signal indicating that the door is closed, controlling the camera to return to the initial position and capture an image of an interior of the refrigerating compartment.

As an improvement of the present invention, the refrigerator control method further comprising: sensing an opening angle of the door by a sensor, wherein the sensor is electrically connected to a controller of the refrigerator and the controller is configured to control a moving path of the camera according to a signal fed back by the sensor.

As an improvement of the present invention, wherein the sensor feeds back a signal to the controller upon sensing that the opening angle of the door is gradually increased, and the controller controls the camera to move from the first position to the second position after determining a signal indicating that the door switches to the open status from the closed status; and the sensor feeds back a signal to the controller upon sensing that the opening angle of the door is gradually decreased, and the controller controls the camera to gradually move to the first position and capture an image of an interior of the door after determining a signal indicating that the door switches to the closed status from the open status.

As an improvement of the present invention, wherein the second position is located between the initial position and the first position.

As an improvement of the present invention, wherein an angle between the first position and the initial position is 55°, and an angle between the second position and the initial position is 30°.

As an improvement of the present invention, wherein "upon acquiring a signal indicating that the door switches to the closed status from the open status or upon acquiring a signal indicating that the opening angle of the door is gradually decreased, controlling the camera to gradually move to the first position and capture an image of an interior of the door" comprises:

gradually moving the camera to the first position and restricting the camera from capturing an image of an interior of the door when the opening angle of the door is greater than the threshold angle; and gradually moving the camera to the first position and controlling the camera to capture an image of an interior of the door when the opening angle of the door is less than the threshold angle.

As an improvement of the present invention, the refrigerator control method further comprising: acquiring an opening angle of the door, comparing the opening angle of the door with the threshold angle, and restricting the camera from capturing an image of an interior of the door when the opening angle of the door is greater than the threshold angle.

As an improvement of the present invention, wherein the threshold angle is 50°.

As an improvement of the present invention, further comprising: performing image segmentation and image pattern recognition on an image captured by the camera to determine food information, wherein the food information comprises a name and a storage location of the food.

As an improvement of the present invention, wherein the controller acquires the signal indicating that a person approaches and wants to open the door of the refrigerator by a human body sensor installed on the door.

Compared with the prior art, the present invention has following advantages. In the refrigerator control method of the present invention, images of interiors of the refrigerating compartment and the door can be captured by only one camera in the refrigerating compartment, which thereby has lower cost.

BRIEF DESCRIPTION OF THE DRAWINGS

The followings will describe some specific embodiments of the present invention in detail in an exemplary rather than restrictive manner with reference to the accompanying drawings. The same reference signs in the drawings represent the same or similar parts. Those skilled in the art shall understand that these drawings may not be necessarily drawn according to the scales. In the drawings.

DETAILED DESCRIPTION

Figure 1:
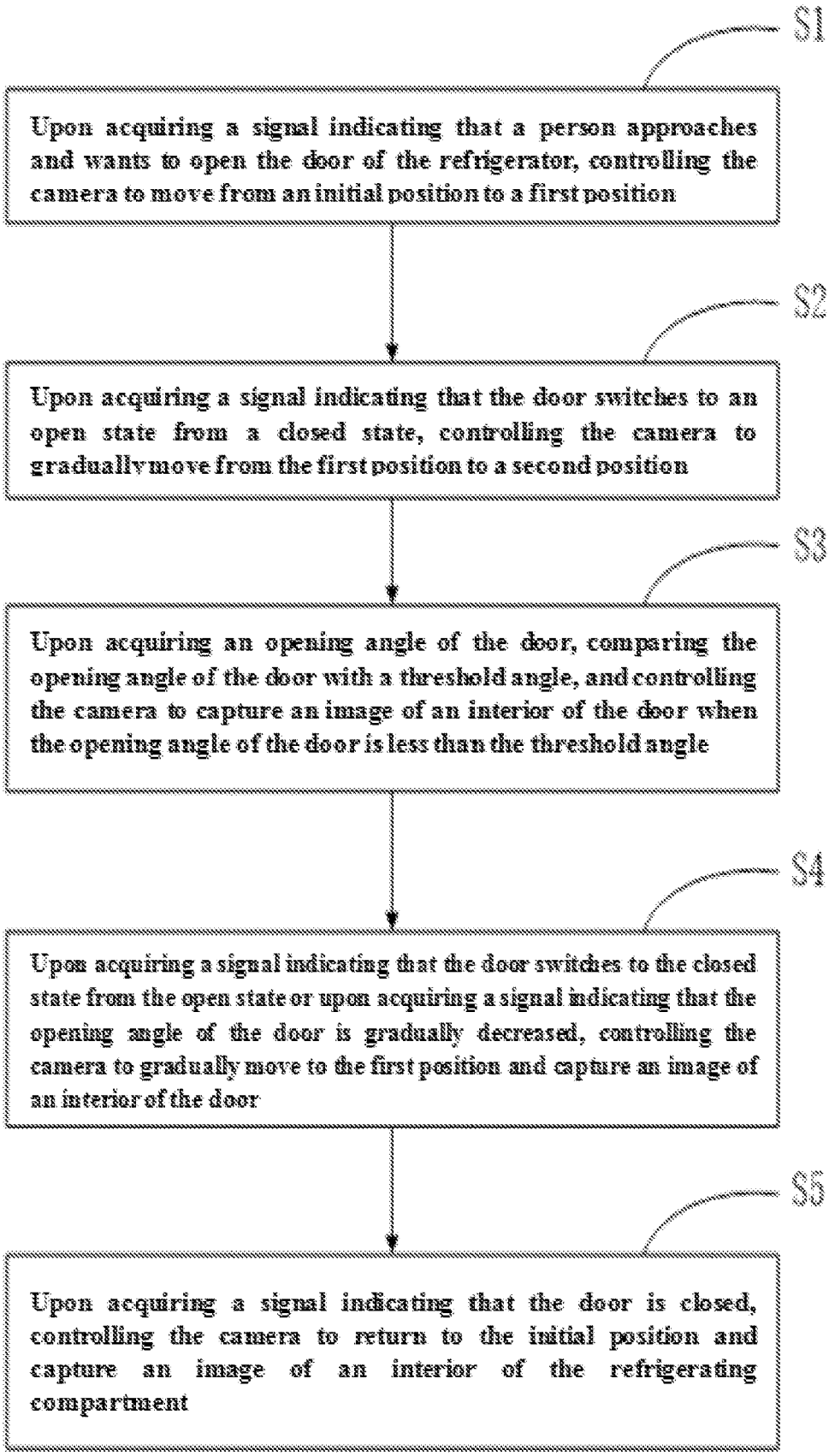
FIG. 1 is a flow chart of steps of a refrigerator control method according to an embodiment of the present invention.

The present invention will be described hereinafter in detail with reference to the embodiments shown in the drawings. However, the embodiments do not limit the present invention, and the functions, methods, or structural equivalent changes or replacements made by those skilled in the art according to the embodiments are all included in the protection scope of the present invention.

Figure 2:
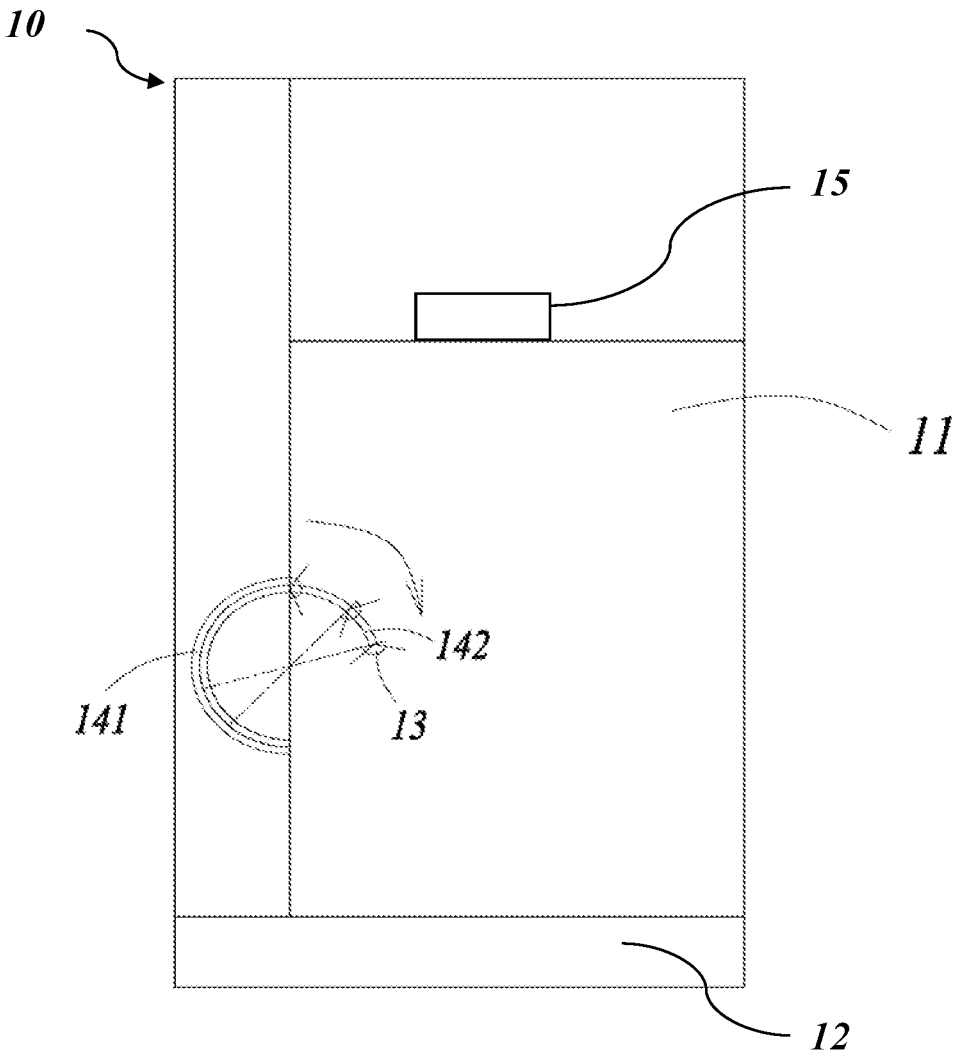
FIG. 2 is a schematic top view showing an installation structure of a camera in a refrigerating compartment of a refrigerator according to an embodiment of the present invention.
Figure 3:
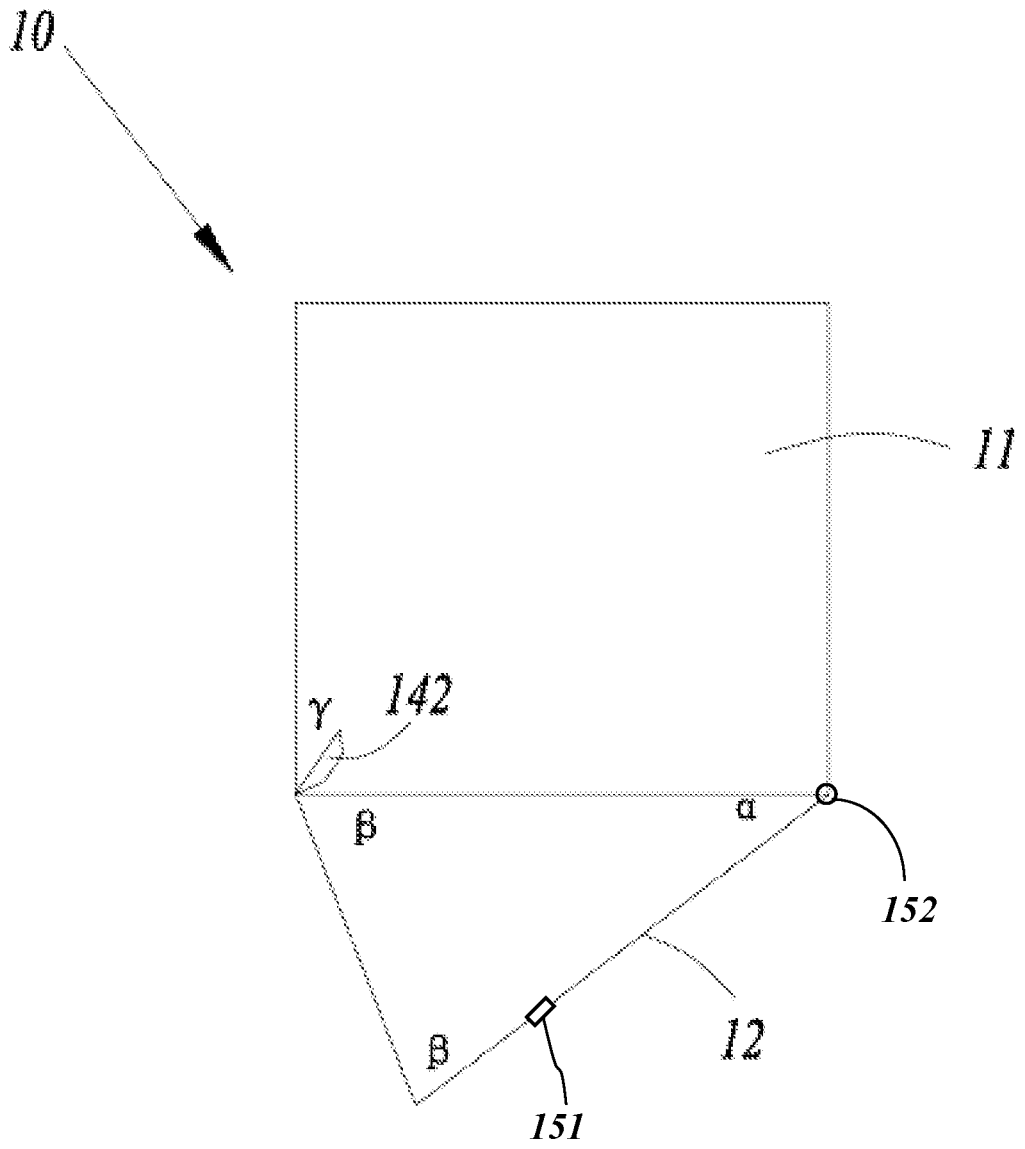
FIG. 3 is a top view of a refrigerator according to an embodiment of the present invention

FIGS. 1 to 3 introduce a preferred embodiment of the refrigerator control method of the present invention. Firstly, a refrigerator 10 comprises: a refrigerating compartment 11, a door 12 closing the refrigerating compartment 11, a camera 13 for capturing images of interiors of the refrigerating compartment 11 and the door 12; a controller 15; and a door sensor 152 for sensing an opening angle of the door 12, the door sensor 152 being electrically connected to the controller 15.

The camera 13 is movably provided at an upper portion of an inner side wall of the refrigerating compartment 11. In detail, a sliding track assembly is provided at the upper portion of the inner side wall of the refrigerating compartment 11. The sliding track assembly comprises an arc track 141 fixed in the refrigerating compartment 11 and a sliding track 142 sliding along the arc track 141. The camera 13 is fixedly installed on the sliding track 142 to move with the sliding track 142. In the present invention, a driving motor (not shown in drawings) is used to drive the sliding track 142 to slide along the arc track 141. Here, the driving motor is electrically connected to a controller 15 of the refrigerator, and the controller 15 is configured to control the driving motor to rotate forward or backward according to the signal fed back by the door sensor 152, so that the sliding track 142 can slide back and forth along the arc track 141. Preferably, the controller 15 may be an integrated circuit including a micro controller unit (MCU). As well known by those skilled in the art, the MCU may comprise a central processing unit (CPU), a read-only memory (ROM), a random-access memory (RAM), a timing module, a digital/analog conversion module (A/D Converter), and several input/output ports. Certainly, the control device can also be other forms of integrated circuits, such as application specific integrated circuits (ASICs), field-programmable gate arrays (FPGAs), or the like.

In the present embodiment, the refrigerator control method specifically comprises the following steps.

S1: Upon acquiring a signal indicating that a person approaches and wants to open the door of the refrigerator, the camera is controlled to move from an initial position to a first position. A human body sensor 151 is provided on the door 12 of the refrigerator for sending a signal to the controller 15. Upon acquiring a signal indicating that a person approaches and wants to open the door of the refrigerator, the controller 15 controls the driving motor to rotate forward according to the signal fed back by the human body sensor 151, so that the camera 13 can move clockwise with the sliding track 142 from the initial position to the first position along the arc track 141. Here, the angle $\gamma$ between the first position and the initial position is 55°.

S2: Upon acquiring a signal indicating that the door switches to an open status from a closed status, the camera is controlled to gradually move from the first position to a second position. In the present invention, the opening angle $\alpha$ is sensed by a door sensor 152 that is electrically connected to the controller 15 of the refrigerator. The controller 15 is configured to control the driving motor to rotate forward or backward according to the signal fed back by the door sensor 152. That is, the controller 15 controls the moving path of the camera. The door sensor 152 may feed back a signal to the controller 15 upon sensing that the opening angle $\alpha$ of the door is gradually increased. After determining a signal indicating that the door switches to the open status from the closed status, the controller 15 controls the driving motor to rotate backward, so that the camera 13 can rotate counterclockwise and move from the first position to the second position. The second position is located between the initial position and the first position, and the angle $\gamma$ between the second position and the initial position is 30°.

S3: Upon acquiring an opening angle of the door, the opening angle of the door is compared with a threshold angle, and the camera is controlled to capture an image of an interior of the door when the opening angle of the door is less than the threshold angle. The door sensor 152 may feed back a signal indicating the opening angle to the controller 15 upon sensing an opening angle $\alpha$ of the door. Then, the controller 15 compares the opening angle $\alpha$ with the threshold angle. If the opening angle $\alpha$ is less than the threshold angle, the camera captures the image of an interior of the door; and if the opening angle $\alpha$ is greater than the threshold angle, the camera is restricted from capturing the image of an interior of the door. Because if the opening angle $\alpha$ of the door is too large, the imaging may be delayed and images of the user's head or hand may be captured, which thereby results in a high photo rejection rate. Preferably, the threshold angle is 50°.

As shown in FIG. 3 and Table 1, it can be obtained from big data statistics that the camera can capture the image of the outermost edge of the door when the user opens the door at 10-45°. The assumed theoretical data may be drawn as follows (the wide angle of the camera is 125°:

TABLE 1

| Sequence Number | $\alpha$ | $\beta$ | $\gamma$ |
|---|---|---|---|
| 1 | 0 | — | 0 |
| 2 | 5 | 87.5 | 52.5 |

TABLE 1-continued

| Sequence Number | α | β | γ |
|---|---|---|---|
| 3 | 10 | 85 | 50 |
| 4 | 20 | 80 | 45 |
| 5 | 30 | 75 | 40 |
| 6 | 45 | 67.5 | 32.5 |
| 7 | 50 | 65 | 30 |

S4: Upon acquiring a signal indicating that the door switches to the closed status from the open status or upon acquiring a signal indicating that the opening angle of the door is gradually decreased, the camera is controlled to gradually move to the first position and capture an image of an interior of the door. The door sensor 152 may feed back a signal to the controller 15 upon sensing that the opening angle α of the door is gradually decreased. After determining a signal indicating that the door 12 switches to the closed status from the open status, the controller 15 controls the driving motor to rotate forward, so that the camera 13 can rotate clockwise, gradually move to the first position, and capture an image of an interior of the door 12. When the opening angle α of the door is greater than the threshold angle, the camera 13 is gradually moved to the first position, and is restricted from capturing the image of an interior of the door 12. When the opening angle α of the door is less than the threshold angle, the camera 13 is gradually moved to the first position, captures the image of an interior of the door 12, and compares the former and later images to confirm the food materials taken in and out of the door.

S5: Upon acquiring a signal indicating that the door is closed, the camera is controlled to return to the initial position and capture an image of an interior of the refrigerating compartment. The door sensor 152 may feed back a signal to the controller 15 upon sensing that the door is closed. After a preset time period, the camera 13 returns to the initial position, captures the image of an interior of the refrigerating compartment, and compares the former and later images to confirm the food materials taken in and out of the refrigerating compartment. In this way, images of interiors of the refrigerating compartment and the door can be captured by only one camera, which has lower cost.

It should be noted here that image segmentation and image pattern recognition are performed on the image captured by the camera to determine food information, and the food information comprises the name and the storage location of the food.

It is apparent to those skilled in the art that the present invention is not limited to the details of the above exemplary embodiments, and the present invention can be embodied in other specific forms without departing from the spirit or essential characteristics of the present invention. Therefore, the present embodiments shall be considered as illustrative and not restrictive from any point, and the scope of the present invention is defined by the appended claims rather than the above illustration. Hence, all changes in the meaning and scope of equivalent elements of the claims are included in the present invention. Any reference signs in the claims should not be construed as limiting the claims.

In addition, it should be understood that although the description is described in terms of embodiments, not every embodiment merely includes one independent technical solution. The statement mode of the description is merely for the sake of clarity, and those skilled that should regard the description as a whole. The technical solutions in the respective embodiments may also be combined as appropriate to form other embodiments that can be understood by those skilled in the art.

What is claimed is:

1. A refrigerator control method, the refrigerator comprising a refrigerating compartment, a door closing the refrigerating compartment, and a camera movably disposed in the refrigerating compartment for capturing images of an interior of the refrigerating compartment and the door; the method comprising:

acquiring a signal indicating that a person approaches the door of the refrigerator, and controlling the camera to move with a sliding track along an arc track from an initial position to a first position in response to acquiring the signal indicating that a person approaches the door of the refrigerator;

acquiring a signal indicating that the door switches to an open status from a closed status, and controlling the camera to move with the sliding track along the arc track from the first position to a second position in response to acquiring the signal indicating that the door switches to an open status from a closed status, wherein the distance between the initial position and the first position is larger than the distance between the initial position and the second position;

acquiring an opening angle of the door, comparing the opening angle of the door with a threshold angle, and controlling the camera to capture an image of an interior of the door in response to the opening angle of the door being less than the threshold angle;

acquiring a signal indicating that the door switches to the closed status from the open status or acquiring a signal indicating that the opening angle of the door is decreased, and controlling the camera to move with the sliding track along the arc track to the first position and capture an image of an interior of the door in response to acquiring the signal indicating that the door switches to the closed status from the open status or in response to acquiring the signal indicating that the opening angle of the door is decreased; and acquiring a signal indicating that the door is closed, and controlling the camera to return with the sliding track along the arc track to the initial position and capture an image of an interior of the refrigerating compartment in response to acquiring the signal indicating that the door is closed.

2. The refrigerator control method according to claim 1, further comprising: sensing an opening angle of the door by a door sensor, wherein the door sensor is electrically connected to a controller of the refrigerator, and the controller is configured to control a moving path of the camera according to a signal fed back by the door sensor.

3. The refrigerator control method according to claim 2, wherein the door sensor feeds back a signal to the controller in response to sensing that the opening angle of the door is increased, and the controller controls the camera to move from the first position to the second position after determining a signal indicating that the door switches to the open status from the closed status; and the door sensor feeds back a signal to the controller in response to sensing that the opening angle of the door is decreased, and the controller controls the camera to move to the first position and capture an image of an interior of the door after determining a signal indicating that the door switches to the closed status from the open status.

4. The refrigerator control method according to claim 1, wherein an angle between the first position and the initial position is 55°, and an angle between the second position and the initial position is 30°.

5. The refrigerator control method according to claim 1, wherein the step of "controlling the camera to move to the first position and capture an image of an interior of the door in response to acquiring a signal indicating that the door switches to the closed status from the open status or in response to acquiring a signal indicating that the opening angle of the door is decreased" comprises:

moving the camera to the first position and restricting the camera from capturing an image of an interior of the door in response to the opening angle of the door being greater than the threshold angle; and moving the camera to the first position and controlling the camera to capture an image of an interior of the door in response to the opening angle of the door being less than the threshold angle.

6. The refrigerator control method according to claim 1, further comprising: acquiring an opening angle of the door, comparing the opening angle of the door with the threshold angle, and restricting the camera from capturing an image of an interior of the door in response to the opening angle of the door being greater than the threshold angle.

7. The refrigerator control method according to claim 1, wherein the threshold angle is 50°.

8. The refrigerator control method according to claim 2, wherein the controller acquires the signal indicating that a person approaches the door of the refrigerator by a human body sensor installed on the door.

* * * * *